US011029101B2

(12) United States Patent
Armsden et al.

(10) Patent No.: US 11,029,101 B2
(45) Date of Patent: Jun. 8, 2021

(54) REVERSE HEADER DESIGN FOR THERMAL CYCLE

(71) Applicant: Hanon Systems, Daejeon (KR)

(72) Inventors: Richard Armsden, Billericay (GB); Tom Kelham, Wood Green (GB)

(73) Assignee: HANON SYSTEMS, Daejeon (KR)

( * ) Notice: Subject to any disclaimer, the term of this patent is extended or adjusted under 35 U.S.C. 154(b) by 32 days.

(21) Appl. No.: 16/272,036

(22) Filed: Feb. 11, 2019

(65) Prior Publication Data

US 2020/0256627 A1 Aug. 13, 2020

(51) Int. Cl.

| | |
|---|---|
| ***F28F 9/02*** | (2006.01) |
| ***F28D 7/00*** | (2006.01) |
| ***F28F 1/12*** | (2006.01) |

(52) U.S. Cl.

CPC ..... *F28F 9/0263* (2013.01); *F28D 7/0066* (2013.01); *F28F 1/126* (2013.01); *F28F 9/0246* (2013.01); *F28F 2009/029* (2013.01); *F28F 2225/08* (2013.01); *F28F 2265/26* (2013.01)

(58) Field of Classification Search

CPC ..... F28F 9/0209; F28F 9/0231; F28F 9/0263; F28F 9/04; F28F 9/18; F28F 9/182; F28F 9/185; F28F 2009/029; F28F 2265/26; F28F 1/126; F28F 7/066

See application file for complete search history.

(56) References Cited

U.S. PATENT DOCUMENTS

| | | | | |
|---|---|---|---|---|
| 4,309,987 | A * | 1/1982 | Higgins, Jr. | F28F 9/026 126/664 |
| 5,605,191 | A * | 2/1997 | Eto | F28D 1/035 165/153 |
| 8,439,104 | B2 * | 5/2013 | de la Cruz | F28F 9/0282 165/174 |
| 10,101,096 | B2 | 10/2018 | Honma et al. | |
| 2005/0039900 | A1 * | 2/2005 | Yu | F28F 9/182 165/173 |
| 2005/0263263 | A1 * | 12/2005 | Merklein | F28D 1/05366 165/76 |
| 2006/0144579 | A1 * | 7/2006 | Ozaki | F28F 9/182 165/173 |
| 2007/0000657 | A1 * | 1/2007 | Emrich | F28F 9/02 165/173 |

(Continued)

FOREIGN PATENT DOCUMENTS

| | | |
|---|---|---|
| JP | 2000213889 A | 8/2000 |
| JP | 2014169851 A | 9/2014 |

(Continued)

*Primary Examiner* — Eric S Ruppert
*Assistant Examiner* — Hans R Weiland
(74) *Attorney, Agent, or Firm* — Shumaker, Loop & Kendrick, LLP; James D. Miller

(57) ABSTRACT

A header for a header tank of a heat exchanger comprises a header wall defining a tube receiving portion having a plurality of longitudinally spaced tube openings formed therethrough. The tube receiving portion includes a planar portion and an adjacent offset portion. The planar portion is disposed on a first plane and the offset portion has a variable distance from the first plane as the offset portion extends away from the planar portion with respect to a longitudinal direction of the header.

17 Claims, 5 Drawing Sheets

(56) References Cited

U.S. PATENT DOCUMENTS

| | | | | |
|---|---|---|---|---|
| 2007/0119580 | A1* | 5/2007 | Wawzyniak | F28F 9/0282 165/174 |
| 2012/0247742 | A1* | 10/2012 | Mizuno | F28D 1/05391 165/173 |
| 2012/0298344 | A1* | 11/2012 | McDonnell | F28F 9/18 165/173 |
| 2017/0328637 | A1* | 11/2017 | Parola | F28D 1/0443 |
| 2018/0283806 | A1* | 10/2018 | Riondet | F28F 9/0226 |
| 2018/0363987 | A1* | 12/2018 | Itou | F28D 1/0461 |

FOREIGN PATENT DOCUMENTS

| | | | |
|---|---|---|---|
| JP | 2017040457 | A | 2/2017 |
| KR | 20010065601 | A | 7/2001 |

* cited by examiner

REVERSE HEADER DESIGN FOR THERMAL CYCLE

FIELD OF THE INVENTION

The invention relates to a heat exchanger, and more specifically to a header of a tank of the heat exchanger, wherein the header includes at least one portion with a reversed structure for accommodating thermal cycling of the heat exchanger.

BACKGROUND OF THE INVENTION

Heat exchangers typically include a centralized plurality of heat exchanger tubes or passageways connected at each respective end thereof to one of a first header tank and a second header tank. The plurality of heat exchanger tubes forms a heat exchanger core of the heat exchanger for transferring heat energy between two different heat exchanging fluids. The header tanks each typically include a surface that acts as a header having tube openings for receiving end portions of the heat exchanger tubes therein. The header of each of the header tanks is then coupled to a corresponding casing that acts as a fluid reservoir aiding in distributing or collecting a fluid flowing through the heat exchanger tubes.

Heat exchangers may be susceptible to damage due to thermal cycling when various different components of the heat exchanger thermally expand relative to each other as the temperature of the different components is increased or decreased depending on the desired operation of the heat exchanger. For example, heat exchangers may be especially susceptible to failure at the joint formed between each of the heat exchanger tubes and each of the headers. Typically, an end portion of each tube is received through a collar defining one of the tube openings of one of the headers in order to form a joint between an outer surface of the tube and an inner surface of the collar. A rigid and fluid tight connection may be formed at this joint by means of brazing, as one non-limiting example. However, this rigid connection leads to increased stresses at the joint between the tube and the collar of the header when the joint attempts to accommodate the relative thermal expansion occurring between the header and the tube. Repeated cycling of these thermal stresses may accordingly lead to a failure at one of the tube and header joints, thereby causing leakage of the heat exchanging fluid from the corresponding header tank.

It may also be the case that certain portions of the header are especially susceptible to the type of failure discussed hereinabove. It is not uncommon for slight temperature variations to exist at different regions within the heat exchanger as a result of the form and configuration of various components of the heat exchanger such as the header tanks, the headers, and the heat exchanger tubes. This in turn leads to some of the tube and header joints being exposed to substantially different maximum and minimum temperatures during use of the heat exchanger.

For example, in one type of heat exchanger configuration one of the two header tanks includes a partition dividing the header tank into two independent chambers to cause the heat exchanging fluid to follow a substantially U-shaped path as the heat exchanging fluid passes in order through a first one of the chambers of a first header tank, a first set of heat exchanger tubes, an opposing second header tank, a second set of the heat exchanger tubes, and a second one of the chambers of the first header tank. It has been discovered that such heat exchanger configurations may be especially susceptible to failure of the tube and header joints formed to one or both sides of the dividing partition due to the difference in temperature of the heat exchanging fluid when passing through the tubes formed to either side of the dividing partition.

Alternatively, in some other configurations the heat exchanging fluid enters one of the header tanks through an associated fluid port, passes through the heat exchanger tubes, and then exits an opposing second one of the header tanks through an associated fluid port. It has been discovered that such heat exchanger configurations may be especially susceptible to failure at the tube and header joints adjacent end portions of each of the headers, and especially when the fluid port of the corresponding header tank is formed adjacent one of the end portions of one of the headers.

It would therefore be desirable to produce a heat exchanger having a header that better distributes the stresses formed at the tube and header joints thereof due to the effects of thermal cycling.

SUMMARY OF THE INVENTION

Compatible and attuned with the present invention, an improved header configuration for distributing the stresses caused by thermal cycling has been surprisingly discovered.

In an embodiment of the invention, a header for a header tank of a heat exchanger comprises a header wall defining a tube receiving portion having a plurality of longitudinally spaced tube openings formed therethrough. The tube receiving portion includes a planar portion and an adjacent offset portion. The planar portion is disposed on a first plane and the offset portion has a variable distance from the first plane as the offset portion extends away from the planar portion with respect to a longitudinal direction of the header.

In another embodiment of the invention, a header tank for a heat exchanger comprises a casing having a hollow interior and a header coupled to the casing. The header comprises a header wall defining a tube receiving portion having a plurality of longitudinally spaced tube openings formed therethrough. The tube receiving portion includes a planar portion and an adjacent offset portion. The planar portion is disposed on a first plane and the offset portion has a variable distance from the first plane as the offset portion extends away from the planar portion with respect to a longitudinal direction of the header.

In yet another embodiment of the invention, a heat exchanger comprises a first header tank including a hollow first casing and a first header. The first header comprises a header wall defining a tube receiving portion having a plurality of longitudinally spaced tube openings formed therethrough. The tube receiving portion includes a planar portion and an adjacent offset portion. The planar portion is disposed on a first plane and the offset portion has a variable distance from the first plane as the offset portion extends away from the planar portion with respect to a longitudinal direction of the first header. A second header tank includes a hollow second casing and a second header. A plurality of heat exchanger tubes extends between the first header tank and the second header tank.

BRIEF DESCRIPTION OF THE DRAWINGS

The above, as well as other objects and advantages of the invention, will become readily apparent to those skilled in the art from reading the following detailed description of a preferred embodiment of the invention when considered in the light of the accompanying drawings.

DETAILED DESCRIPTION OF THE INVENTION

The following detailed description and appended drawings describe and illustrate various embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
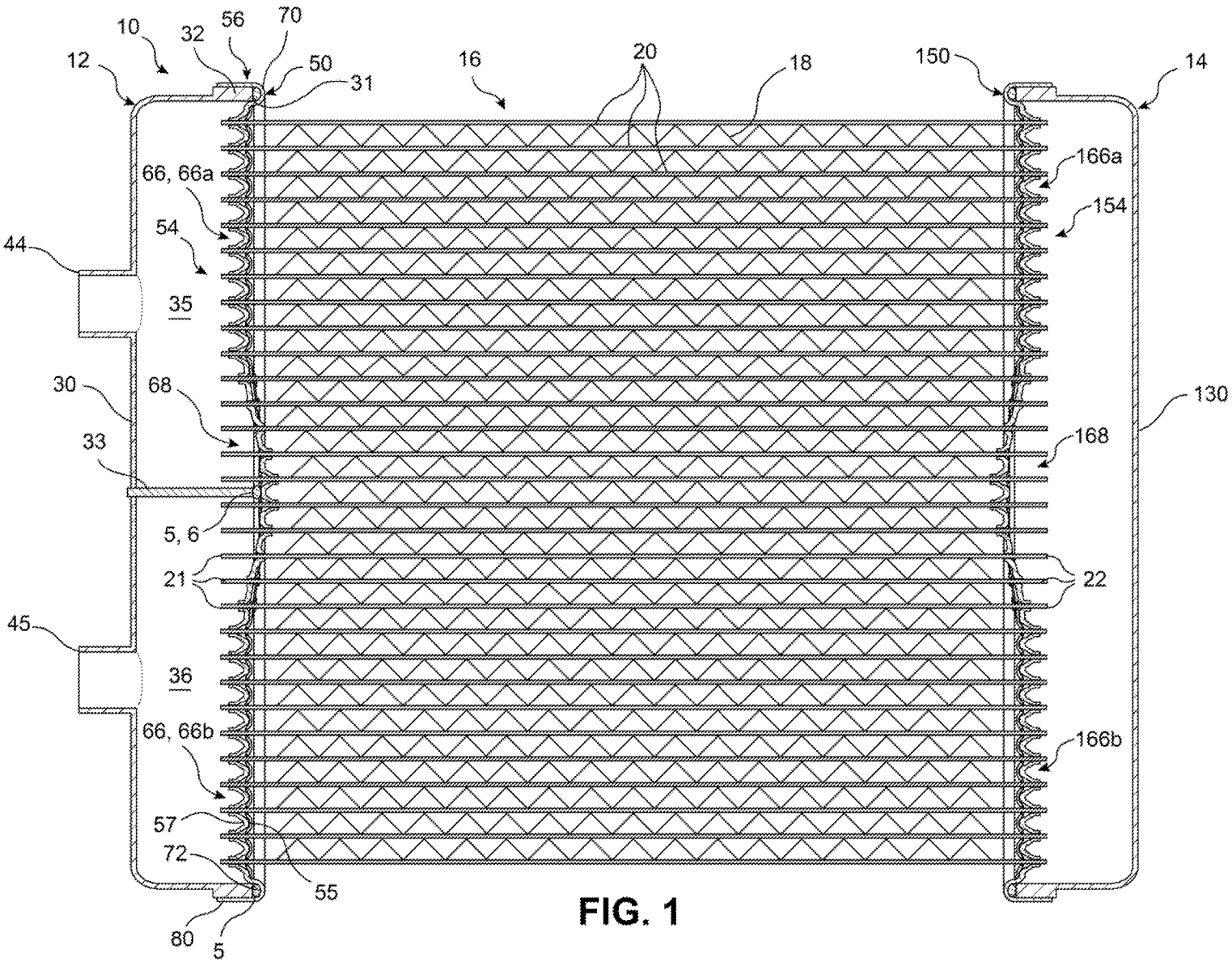
FIG. 1 is an elevational cross-sectional view of a heat exchanger according to the present invention.

FIG. 1 illustrates a heat exchanger 10 according to an embodiment of the invention. The heat exchanger 10 may be used for any heat exchanging application such as forming an evaporator or a condenser of an air conditioning system, a radiator of a cooling system, or a charge air-cooler of a turbocharger system, as non-limiting examples. The heat exchanger 10 may be configured to pass any type of fluid therethrough, including a refrigerant or a coolant, as non-limiting examples. The fluid passed by the heat exchanger 10 may be configured for exchanging heat energy with a flow of air passing through the heat exchanger 10 in a direction arranged substantially perpendicular to a plane generally defined by the heat exchanger 10, but any form of secondary heat exchanging fluid may be used without departing from the scope of the present invention.

The heat exchanger 10 includes a first header tank 12, an oppositely arranged second header tank 14, and a heat exchanger core 16 extending between the first header tank 12 and the second header tank 14. The heat exchanger core 16 is formed by a plurality of spaced apart and parallel heat exchanger tubes 20. The heat exchanger tubes 20 may be any form of heat exchanger tubes, including extruded tubes or folded flat tubes, as non-limiting examples. The heat exchanger core 16 may further include surface area increasing features 18, such as corrugated fins, disposed between adjacent ones of the heat exchanger tubes 20 in order to increase a heat exchange capacity of the heat exchanger 10.

The first header tank 12 includes a hollow first casing 30 and a first header 50. The first casing 30 defines a manifold for distributing or recombining a first fluid passing through each of the heat exchanger tubes 20. The first casing 30 includes a foot 32 extending around a perimeter of a header opening 31 of the first casing 30. The foot 32 generally forms an outwardly flanged portion of the first casing 30. The foot 32 may generally include a substantially rectangular cross-sectional shape as the foot 32 extends around the perimeter of the header opening 31. The foot 32 may be divided into a first foot segment and an oppositely arranged second foot segment meeting at each of two opposing ends of the first casing 30. Further, the first casing 30 may include a first wall segment and an oppositely arranged second wall segment, wherein the first wall segment extends from the first foot segment to a spine of the first casing 30 while the second wall segment extends from the second foot segment to the spine. The first and second wall segments may each be substantially arcuate in shape to form a first casing 30 having a substantially semi-circular or semi-elliptical cross-sectional shape.

The first casing 30 may include a plurality of longitudinally spaced crimp structures (not shown) having a substantially semi-cylindrical shape. Each of the crimp structures may be an integrally formed structure projecting from one of the foot segments and a corresponding one of the wall segments. Each of the crimp structures may include a substantially semi-circular cross-sectional shape for allowing a corresponding structure to be bent or deformed to match the semi-circular shape of each of the crimp structures. The first casing 30 may further include a plurality of spaced apart ribs (not shown) formed on an outer surface thereof with each of the ribs extending from one of the crimp structures disposed on the first foot segment to an opposing one of the crimp structures disposed on the second foot segment. The ribs may be added to the first casing 30 in order to re-inforce the first casing 30 against deformation due to thermal expansion when receiving the first fluid at an elevated pressure therein and other stresses applied to the casing 30.

In the embodiment shown in FIG. 1, the first casing 30 includes a partition 33 dividing an interior of the first casing 30 into a first chamber 35 and a second chamber 36. The partition 33 may be an insert received in the first casing 30 arranged on a plane substantially perpendicular to a longitudinal axis of the first casing 30. The partition 33 extends across the first casing 30 to prevent direct fluid communication between the first chamber 35 and the second chamber 36 with respect to the heat exchanging fluid circulated within the first casing 30.

The first casing 30 includes a first fluid port 44 providing fluid communication between the first chamber 35 of the first casing 30 and the remainder of a fluid system conveying the first fluid therethrough. The first fluid port 44 may form an inlet or an outlet of the first casing 30 depending on a direction of flow of the first fluid through the heat exchanger 10, and especially in cases where the heat exchanger 10 is configured to be passable bi-directionally to accommodate multiple different modes of operation of the associated fluid system.

The first casing 30 further includes a second fluid port 45 providing fluid communication between the second chamber 36 of the first casing 30 and the remainder of a fluid system conveying the first fluid therethrough. The second fluid port 45 may similarly form an inlet or an outlet of the first casing 30 depending on a direction of flow of the first fluid through the heat exchanger 10.

The first fluid port 44 and the second fluid port 45 are each shown as a cylindrical conduit intersecting the first casing 30 and arranged substantially parallel to a direction of extension of the heat exchanger tubes 20, but it should be understood that the first fluid port 44 and the second fluid port 45 may have any cross-sectional shape and any orientation relative to the first casing 30 without departing from the scope of the present invention. The fluid ports 44, 45 are also shown as intersecting each respective chamber 35, 36 of the first casing 30 at a central region thereof, but the fluid ports 44, 45 may alternatively intersect the first casing 30 at any suitable position for causing the flow configuration of FIG. 1 without departing from the scope of the present invention.

The first casing 30 may be formed from a polymeric material such as a rigid plastic material suitable for withstanding the internal pressure of the first fluid when passing through the first casing 30. The first casing 30 may accordingly be formed in a suitable molding operation, as one non-limiting example. However, it is understood other materials can be used as desired without departing from the scope of the invention.

The second header tank 14 includes a hollow second casing 130 and a second header 150. The second casing 130 includes substantially similar structure to the first casing 30 except the second casing 130 of the present embodiment is devoid of any fluid ports for communicating the first fluid to a remainder of the associated fluid system. Instead, the second casing 130 is used as a turn-around for the first fluid to cause the first fluid to follow a substantially U-shaped flow path when flowing through the heat exchanger 10.

The first header 50 is shown in isolation in FIGS. 2-6 to better illustrate the features thereof. The first header 50 generally includes a header wall 52 contoured to define each of a tube receiving portion 54, a coupling portion 56, and a connecting portion 58 of the first header 50. The header wall 52 includes an outer face 55 facing towards the second header tank 14 and an inner face 57 facing towards the first casing 30 while also defining a portion of each of the first chamber 35 and the second chamber 36 of the first header tank 12. The first header 50 extends in a longitudinal direction thereof from a first end 61 to a second end 62. The first header 50 further includes a first longitudinal side 63 and an opposing second longitudinal side 64 separated from each other by a width direction of the first header 50. The contoured portions of the header wall 52 are further disposed on different planes of the first header 50 separated from each other in a height or depth direction of the first header 50, wherein the height or depth direction is arranged perpendicular to each of the longitudinal direction and the width direction.

The coupling portion 56 of the first header 50 includes a trough 70 and a plurality of crimping walls 80 extending from an outer portion of the trough 70 in the height direction of the first header 50. The trough 70 extends circumferentially around a perimeter of the tube receiving portion 54 of the header wall 52 and is configured to receive the foot 32 of the first casing 30 therein. The tube receiving portion 54 may include a substantially rounded-rectangular or rectangular perimeter shape, as desired, hence the trough 70 may similarly extend circumferentially in a substantially rounded-rectangular or rectangular perimeter shape while circumscribing the tube receiving portion 54. However, the tube receiving portion 54 and the surrounding trough 70 may include any suitable longitudinally extending perimeter shape while remaining within the scope of the present invention, such as an elongated elliptical shape, as one non-limiting example.

In the illustrated embodiment, the trough 70 includes four of the crimping walls 80 extending therefrom, with one of the crimping walls 80 corresponding to each of the first end 61, the second end 62, the first longitudinal side 63, and the second longitudinal side 64 of the first header 50. The crimping walls 80 are configured to be inwardly deformed relative to the foot 32 of the first casing 30 when the foot 32 is received within the trough 70, thereby coupling the first header 50 to the first casing 30. A distal end of each of the crimping walls 80 may include an outwardly flared portion 81 configured to aid in locating the foot 32 of the first casing 30 when received within the trough 70 of the first header 50. The crimping walls 80 may further include one or more openings 82 formed therein and spaced from each other about the circumferential direction of the trough 70. The openings 82 may be provided to aid in inwardly deforming the crimping walls 80 towards the foot 32 at spaced intervals about the circumference of the trough 70 to provide an interference fit therebetween, as desired. As mentioned earlier, the foot 32 of the first casing 30 may include a plurality of semi-circular crimp structures forming a surface about which the crimping walls 80 are deformed for forming the interference fit.

Figure 4:
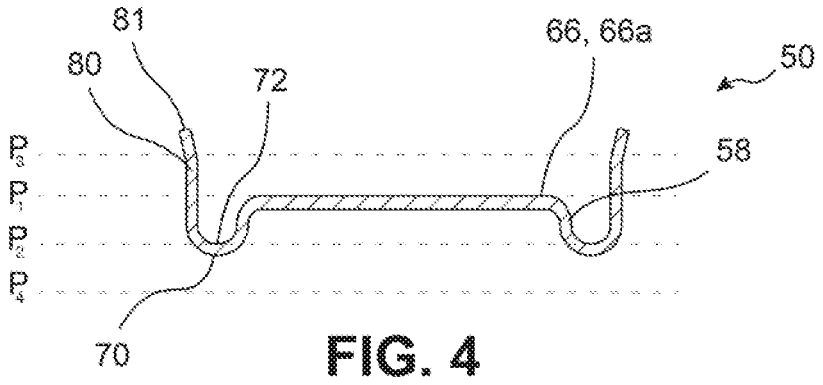
FIG. 4 is a cross-sectional view of the header as taken through lines 4-4 of FIG. 3.

The trough 70 is shown in FIG. 4 as including a substantially arcuate semi-circular cross-sectional shape, but it should be understood that any substantially concave surface or structure may form the trough 70 without necessarily departing from the scope of the present invention. The trough 70 may alternatively be formed by a substantially planar surface arcing upwardly to either side of the planar surface, as one non-limiting example. Regardless of the shape of the trough 70, the trough 70 defines a seal engaging surface 72 extending circumferentially about the perimeter of the first header 50. In the provided example, the seal engaging surface 72 is formed by a lowermost portion of the semi-circular cross-sectional shape of the trough 70 as shown from the perspective of FIG. 4.

The seal engaging surface 72 is configured to engage a sealing element 5, wherein the sealing element 5 is configured to be compressed between the trough 70 of the first header 50 and the foot 32 of the first casing 30 when the first header 50 and the first casing 30 are coupled to each other via a method such as the crimping described hereinabove. The sealing element 5 may include substantially the same perimeter shape as the trough 70 while further including a strip 6 extending between opposing side surfaces of the sealing element 5, wherein the strip 6 is configured to engage a surface of the partition 33 facing towards the first header 50 when the first header 50, the first casing 30, and the partition 33 are in the assembled configuration in order to prevent fluid communication between the first chamber 35 and the second chamber 36.

The tube receiving portion 54 of the header wall 52 includes a substantially planar portion 66 disposed on a first plane $P_1$ of the first header 50 and an offset portion 68 deviating from the first plane $P_1$ of the first header 50. The first plane $P_1$ is defined by the longitudinal and width directions of the first header 50 to cause the first plane $P_1$ to be arranged perpendicular to the direction of extension of the heat exchanger tubes 20. The first plane $P_1$ is spaced in the height direction of the first header 50 from a second plane $P_2$ of the first header 50 defined by the circumferentially extending seal engaging surface 72 of the trough 70, wherein the first plane $P_1$ and the second plane $P_2$ are arranged parallel to each other.

Figure 2:
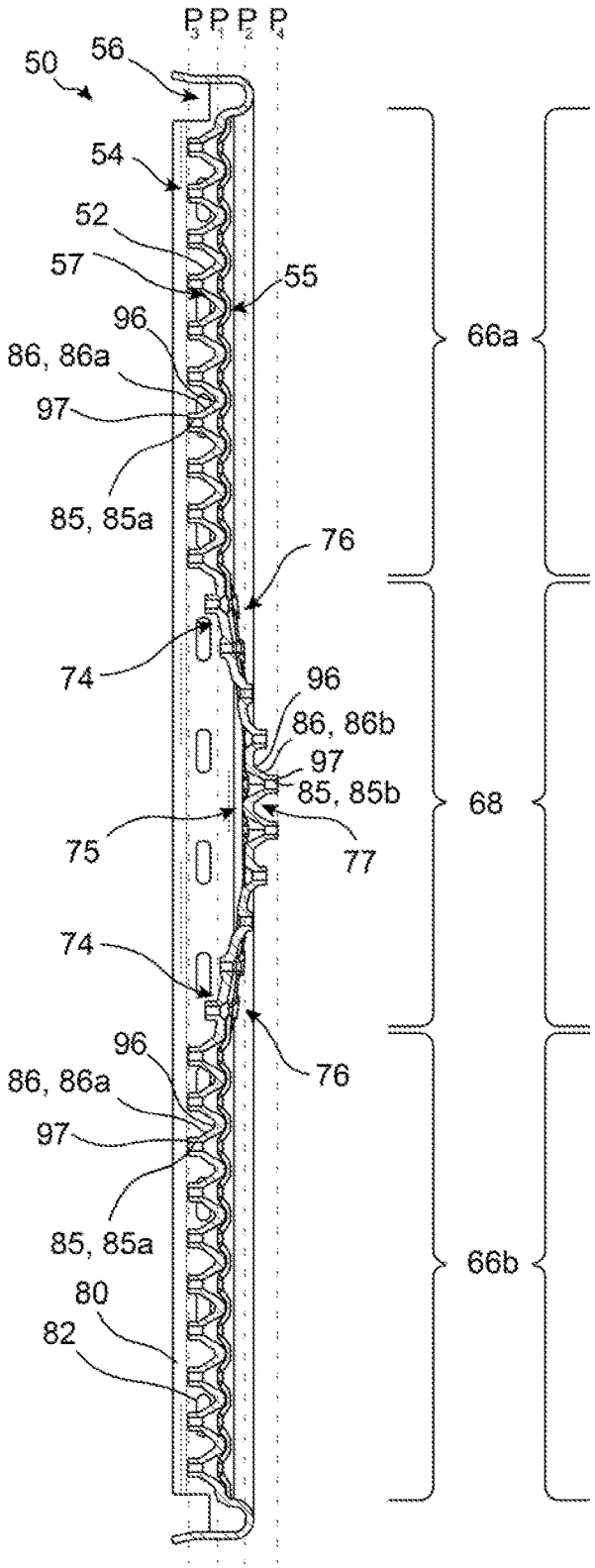
FIG. 2 is an elevational cross-sectional view of a header of the heat exchanger of FIG. 1.
Figure 3:
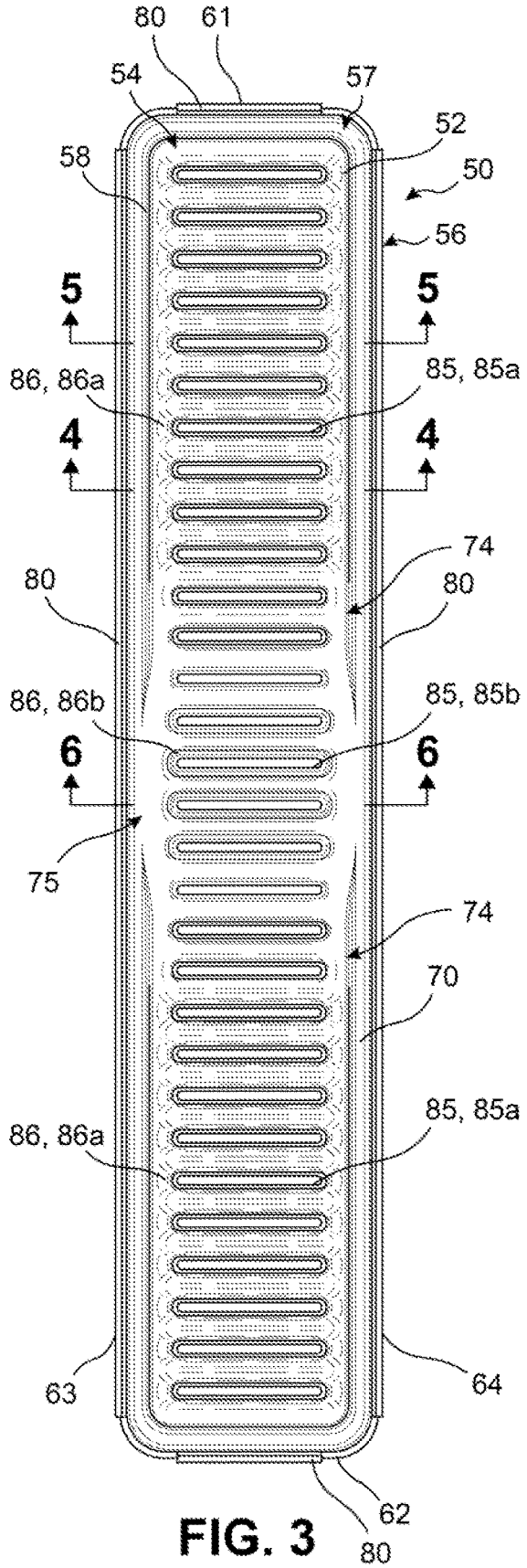
FIG. 3 is a front elevational view of the header of FIG. 2.
Figure 6:
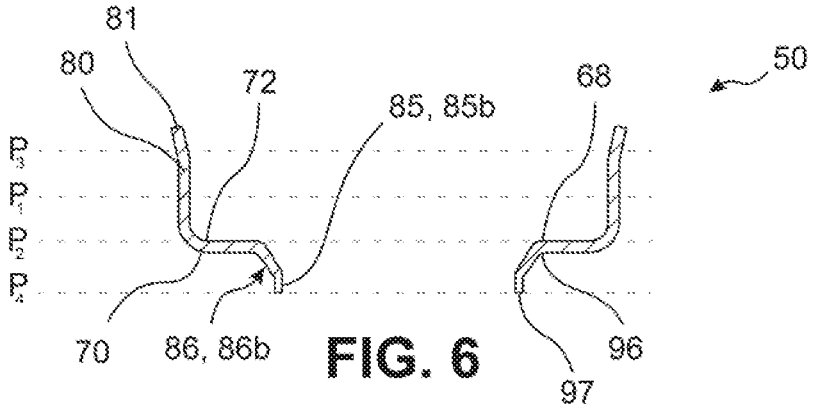
FIG. 6 is a cross-sectional view of the header as taken through lines 6-6 of FIG. 3.

The connecting portion 58 of the first header 50 forms a wall extending between the trough 70 and the tube receiving portion 54 about a perimeter of the first header 50. As shown in FIGS. 2 and 3, the offset portion 68 of the tube receiving portion 54 curves away from the first plane $P_1$ defined by the planar portions **66*a*, 66*b* before eventually being arranged on and parallel to the second plane $P_2$ defined by the seal engaging surface 72 of the trough 70. As best shown in FIG. 6, the transition from the first plane $P_1$ to the second plane $P_2$ causes the connecting portion 58** to reduce in slope relative to the second plane $P_2$ until the connecting portion 58 merges into the co-planar seal engaging surface 72 and tube receiving portion 54 along a central region of the offset portion 68.

In the provided embodiment, the planar portion 66 of the tube receiving portion 54 is divided into a first planar portion 66*a* and a second planar portion 66*b*, wherein the offset portion 68 is disposed intermediate the first and second planar portions 66*a*, 66*b*. The first planar portion 66*a* extends from a position adjacent the first end 61 of the first header 50 toward a central portion of the first header 50 including the offset portion 68 while the second planar portion 66*b* extends from a position adjacent the second end 62 of the first header 50 toward the central portion of the first header 50 including the offset portion 68. A length of the first planar portion 66*a*, the offset portion 68, and the second planar portion 66*b* may be dependent on a configuration of the first header tank 12, including a positioning of any one of the fluid ports 44, 45 or the partition 33, as desired.

As best shown in FIGS. 2-6, the tube receiving portion 54 further includes a plurality of tube openings 85 formed therein and extending through the header wall 52 from the outer face 55 to the inner face 57 thereof. The tube openings 85 may be substantially rectangular or rounded-rectangular in shape with a longitudinal dimension extending in the width direction of the first header 50. The tube openings 85 may be substantially evenly spaced from each other with respect to the longitudinal direction of the first header 50, but any spacing may be used without necessarily departing from the scope of the present invention.

Each of the tube openings 85 is formed through a distal end 97 of a corresponding tube projection 86 of the tube receiving portion 54. Each of the tube projections 86 is formed by a portion the header wall 52 bent or curved away from one of the first plane $P_1$ defined by the first and second planar portions 66*a*, 66*b* or the curvilinear shape formed by the offset portion 68 as it curves away from the first plane $P_1$. Each of the tube projections 86 includes a base 96 wherein the header wall 52 first curves away from the surrounding planar or curvilinear surface of the tube receiving portion 54. A height of each of the tube projections 86 is accordingly measured between the base 96 and the distal end 97 thereof with respect to the height direction of the first header 50.

The tube projections 86 may be divided into a plurality of first tube projections 86*a* projecting from the planar portions 66*a*, 66*b* of the tube receiving portion 54 and a plurality of second tube projections 86*b* projecting from the offset portion 68 of the tube receiving portion 54. The tube openings 85 may similarly be divided into a plurality of first tube openings 85*a* formed through the first tube projections 86*a* of the planar portions 66*a*, 66*b* and a plurality of second tube openings 85*b* formed through the second tube projections 86*b* of the offset portion 68.

Figure 5:
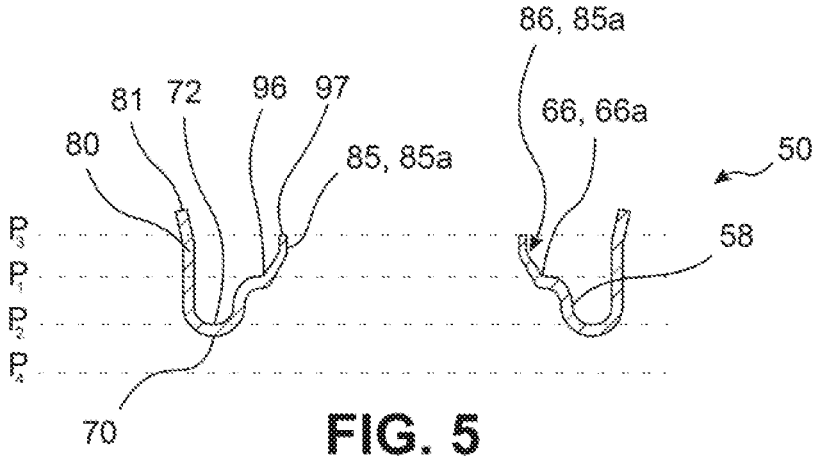
FIG. 5 is a cross-sectional view of the header as taken through lines 5-5 of FIG. 3.

In the illustrated embodiment, a planar surface defining each of the planar portions 66*a*, 66*b* is shown as substantially surrounding each of the first tube projections 86*a* about an entirety of a perimeter thereof, including being present between adjacent ones of the first tube projections 86*a* (FIG. 4) as well as being present between each of the first tube projections 86*a* and the laterally disposed connecting portion 58 (FIG. 5). However, in some embodiments, the first tube projections 86*a* may extend laterally to merge at least partially with the connecting portion 58 of the first header 50 to each lateral side of the first tube openings 85*a*, thereby resulting in the planar portions 66*a*, 66*b* being present only between adjacent ones of the first tube projections 86*a*. Either configuration may be used without departing from the scope of the present invention.

As mentioned above, the offset portion 68 of the tube receiving portion 54 curves away from the first plane $P_1$ defined by the planar portions 66*a*, 66*b* until the offset portion 68 is arranged on and parallel to the second plane $P_2$ defined by the seal engaging surface 72 of the trough 70. Specifically, with reference to the inner face 57 of the header wall 52, the offset portion 68 includes a pair of substantially convex surfaces 74 where the offset portion 68 initially curves away from each of the planar portions 66*a*, 66*b* and a centrally located concave surface 75 formed between the convex surfaces 74. Each of the convex surfaces 74 of the inner face 57 corresponds to a concave surface 76 of the outer face 55 while the concave surface 75 of the inner face 57 corresponds to a convex surface 77 of the outer face 55. For clarity, the contour of the offset portion 68 of the tube receiving portion 54 is hereinafter primarily described by reference to only the convex surfaces 74 and the concave surface 75 of the inner face 57, as opposed to referring to the concave surfaces 76 and the convex surface 77 of the outer face 55. The transition from the planar portions 66*a*, 66*b* to the convex surfaces 74 and then to the concave surface 75 causes the offset portion 68 to include a curvilinear and substantially arcuate profile from the perspective of FIG. 2 absent sharp changes as the first header 50 extends longitudinally.

As best shown in FIG. 2, each of the first tube projections 86*a* projects away from the inner face 57 of the header wall 52 in a first direction parallel to the direction of extension of the heat exchanger tubes 20 and hence the height direction of the first header 50. Each of the first tube projections 86*a* includes a common height relative to the planar portions 66*a*, 66*b* wherein the distal end 97 of each of the first tube projections 86*a* is disposed on a third plane $P_3$ of the first header 50 spaced from the first plane $P_1$ of the first header 50 in the height direction thereof, wherein the third plane $P_3$ is spaced from the first plane $P_1$ in a direction opposite the spacing of the second plane $P_2$ from the first plane $P_1$. The first tube projections 86*a* projecting in the first direction corresponds to the first tube projections 86*a* projecting inwardly towards an inner surface of the first casing 30 when the first header 50 is coupled to the first casing 30.

In contrast to the first tube projections 86*a*, the second tube projections 86*b* include a variable height and a variable direction of extension as the offset portion 68 progresses inwardly toward a central region thereof from each of the surrounding planar portions 66*a*, 66*b*. More specifically, the second tube projections 86*b* include a maximum height adjacent each of the planar portions 66*a*, 66*b* while projecting inwardly in the first direction in similar fashion to the first tube projections 86*a*. As the offset portion 68 progresses inwardly toward the central region thereof, a height of each of the second tube projections 86*b* successively decreases relative to the inner face 57 while still projecting in the first direction. The second tube projections 86*b* eventually reverse in direction relative to the height direction of the first header 50 to project in an outward direction from the outer face 55 towards the second header tank 14 while the height of each of the second tube projections 86*b* successively increases as the offset portion 68 progresses inwardly towards a central region thereof. The offset portion 68 of the tube receiving portion 54 accordingly includes a transition of a direction of projection of the second tube projections 86*b* that includes a maximum extent of projection in a first direction towards the first casing 30 adjacent the planar portions 66*a*, 66*b* and a maximum extent of projection in a second direction towards the second header tank 14 at a central region of the offset portion 68 arranged on the third plane $P_3$.

Figure 7:
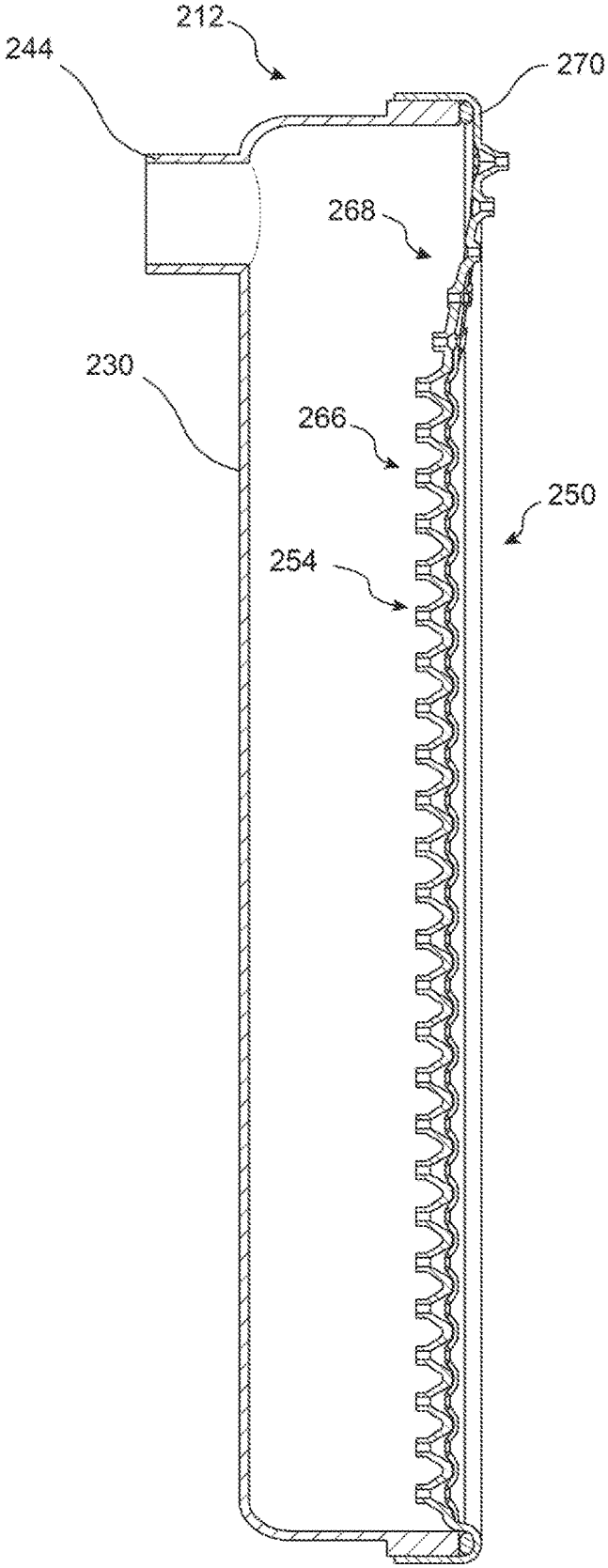
FIG. 7 is an elevational cross-sectional view of a header tank having a header according to another embodiment of the invention.

The change in the direction of projection of the second tube projections 86*b* may occur at each of the transitions between the centrally located convex surface 75 and each of the outwardly located concave surfaces 74 of the inner face 57. For example, as shown in FIG. 2, the height of each of the second tube projections 86*b* successively decreases along each of the concave surfaces 74 when progressing inwardly towards the convex surface 75 with the second tube projections 86*b* projecting in the first direction towards the first casing 30. In contrast, the height of each of the second tube projections 86*b* successively increases along the convex surface 75 when progressing inwardly towards the center of the convex surface 75 disposed on the third plane $P_3$ while the second tube projections 86 project in the second direction towards the second header tank 14. As shown in FIG. 7, the distal end 97 of each the second tube projections 86*b* formed immediately to either side of the center of the concave surface 75 of the inner face 57 is disposed on a fourth plane $P_4$ spaced from and arranged parallel to the second plane P2, wherein the fourth plane $P_4$ is spaced from the second plane $P_2$ in a direction opposite the spacing of the first plane $P_1$ from the second plane $P_2$.

In the illustrated embodiment, the second header 150 includes the same structure as the first header 50 while arranged symmetrically thereto, hence each of the features described with reference to the first header 50 may be aligned with a corresponding feature of the second header 150 with respect to the longitudinal directions thereof. For example, the second header 150 includes a tube receiving portion 154 including a first planar portion 166*a*, a second planar portion 166*b*, and a centrally located offset portion 168, wherein each of the features is aligned with a corresponding feature of the first header 50.

As shown in FIG. 1, a first end portion 21 of each of the heat exchanger tubes 20 extending beyond the first header 50 is disposed in the first header tank 12 while a second end portion 22 of each of the heat exchanger tubes 20 extending beyond the second header 150 is disposed in the second header tank 14. In the provided embodiment, each of the heat exchanger tubes 20 includes the same length to cause those first and second end portions 21, 22 passing through each of the offset portions 68, 168 of each of the headers 50, 150 to have an increasing length when progressing towards the center of the corresponding offset portion 168. A length of a portion of each of the heat exchanger tubes 20 disposed between the first and second headers 50, 150 accordingly decreases when progressing towards the center of the corresponding offset portion 68, 168. However, in other embodiments, the heat exchanger tubes 20 may be selected to include variable lengths corresponding to the shapes of the first and second headers 50, 150 in order to cause each of the end portions 21, 22 to have a common length disposed within each respective header tank 12, 14, as desired.

Assembly of the heat exchanger 10 includes coupling the first and second headers 50, 150 to the first and second casings 30, 130 in the manner described hereinabove, assembling the heat exchanger core 16 into the configuration of FIG. 1, inserting the opposing first and second end portions 21, 22 of each of the heat exchanger tubes 20 into each of the opposing first and second header tanks 12, 14, and then coupling the heat exchanger core 16 together while also coupling the heat exchanger core 16 to each of the opposing first and second headers 50, 150. The coupling of the heat exchanger core 16 and the first and second headers 50, 150 may be accomplished by a brazing process, thereby forming a metal bonded joint at each intersection of each of the heat exchanger tubes 20 with the first and second headers 50, 150. However, other forms of metal bonding, such as welding, may also be used without necessarily departing from the scope of the present invention, so long as a fluid tight seal is formed at each joint between the heat exchanger tubes 20 and the first and second headers 50, 150. The heat exchanger core 16 and each of the first and second headers 50, 150 may accordingly be formed from the same metallic materials or from two complimentary metallic materials suitable for undergoing a metal bonding process such as brazing. The heat exchanger core 16 and the first and second headers 50, 150 may be formed from aluminium or alloys thereof, as one non-limiting example. It should be appreciated by one skilled in the art that the first and second headers 50, 150 may be coupled to the first and second casings 30, 130 via alternative means to those described herein while still appreciating the benefits of the present invention as described hereinafter.

In use, the first fluid enters the first header tank 12 through the first fluid port 44 where the first fluid is distributed to a first set of the heat exchanger tubes 20 extending into the first chamber 35. The first fluid then passes through the first set of the heat exchanger tubes 20 while exchanging heat energy with a second fluid passing between the heat exchanger tubes 20. The first fluid is then recombined within the second header tank 14 before passing through a second set of the heat exchanger tubes 20 while again exchanging heat energy with the second fluid. The first fluid is again recombined within the second chamber 36 of the first header tank 12 before exiting the heat exchanger 10 through the second fluid port 45. The heat exchanger 10 accordingly includes a substantially U-shaped flow configuration with the partition 33 forming a boundary between the opposing flows of the first fluid through the heat exchanger tubes 20.

During the passage of the first fluid through the heat exchanger tubes 20, the heat exchanger tubes 20 may be cooled or heated over a given period of time, thereby causing the heat exchanger tubes 20 to increase or decrease in length due to the effects of thermal expansion and contraction over the same period of time. Varying conditions regarding the operation or specific configuration of the heat exchanger 10 may cause different ones of the heat exchanger tubes 20 to experience the first fluid at varying temperatures or to have varying degrees of heat transfer across each of the heat exchanger tubes 20. Furthermore, a change in the mode of operation of the associate fluid system may cause the conditions within the heat exchanger tubes 20 to change drastically upon a reversal of the operational mode or the like, such as when the heat exchanger 10 is passable bi-directionally such that the first fluid has varying characteristics depending on the direction of flow thereof.

In some circumstances, the first fluid has a different temperature when reaching some of the heat exchanger tubes 20 than others due to a varying distance between the corresponding fluid port 44, 45 associated with distributing the first fluid to the heat exchanger tubes 20 and each of the end portions 21, 22 of the heat exchanger tubes 20. In other circumstances, the first fluid may flow through some of the heat exchanger tubes 20 while having a different pressure, flow rate, degree of turbulence, or the like in comparison to other heat exchanger tubes 20, thereby varying the heat transfer across the different heat exchanger tubes 20. Still, in other circumstances, the flowing of the first fluid through the heat exchanger tubes 20 including two or more passes of the first fluid through the heat exchanger tubes 20 causes the first fluid to have a different temperature when encountering the downstream arranged heat exchanger tubes 20, such as when flowing to either side of the partition 33 in the U-shaped flow configuration illustrated in FIG. 1. One skilled in the art should appreciate various other conditions or flow configurations causing the varying temperature of the different heat exchanger tubes 20 in addition to those described herein.

The expansion or contraction of the heat exchanger tubes 20 accordingly applies a stress at each metal bonded joint formed between each of the heat exchanger tubes 20 and each of the first and second headers 50, 150 that tends to separate or bring together the opposing first and second headers 50, 150. The first and second headers 50, 150 may further experience a bending moment as a result of the expansion or contraction of the heat exchanger tubes 20 relative to each of the first and second headers 50, 150, which introduces additional stresses to the first and second headers 50, 150. A repeated change in the temperature of each of the heat exchanger tubes 20 may further cause the stresses to be cycled, and may even cause the stresses to be cycled in opposing directions depending on the variability of the temperature of each of the heat exchanger tubes 20. Those heat exchanger tubes 20 subject to the greatest difference in temperature during use of the heat exchanger 10 or those heat exchanger tubes 20 having the greatest difference in temperature from the remaining heat exchanger tubes 20 may accordingly be the heat exchanger tubes 20 most likely to fail as a result of the thermal cycling as the greatest stresses will likely be present at these locations.

The present invention prevents the above mentioned failure from thermal cycling by better distributing the stresses experienced by the heat exchanger tubes 20, the first and second headers 50, 150, and each of the metal bonded joints formed therebetween. Specifically, the curvilinear shape of the offset portion 68 better distributes the stresses experienced by the first and second headers 50, 150 in comparison to a header having all tube to header joints formed on a single plane. The gradually curved shape of the offset portion 68 allows for the stresses experienced within each of the headers 50, 150 to be distributed across a greater length of each of the headers 50, 150 while also varying a plane on which the stresses act on each of the headers 50, 150. The curvature of each of the offset portions 68, 168 further allows for each of the headers 50, 150 to be flexed in a desired manner when experiencing the thermal cycling, thereby causing a reduced stress to be carried through each of the metal bonded joints which in turn reduces a stress experienced by each of the heat exchanger tubes 20. The reversal of the direction of projection of the second tube projections **86*b* when progressing inwardly further promotes the distributing of the stresses within the offset portion 68 without introducing sharp changes in direction that could introduce undesirable stress risers within each of the headers 50, 150. Lastly, the varying of the distance between the opposing headers 50, 150 as a result of each of the offset portions 68, 168 extending towards each other actually causes those heat exchanger tubes 20 engaging each of the offset portions 68, 168 to have a decreased length between the opposing metal bonded joints thereof, which actually causes each of the heat exchanger tubes 20** to experience less thermal expansion or contraction due to the reduced dimension present between the opposing metal bonded joints. As such, a variation of the length between the opposing metal bonded joints due to thermal expansion or contraction is reduced in a manner reducing the stresses carried by each of the metal bonded joints.

FIG. 7 illustrates a header tank 212 having a header 250 according to another embodiment of the invention. The header tank 212 includes a casing 230 having a fluid port 244 disposed adjacent a first end of the casing 230. The header 250 includes a tube receiving portion 254 having a planar portion 266 and an offset portion 268. As can be seen in FIG. 7, the planar portion 266 and the offset portion 268 include substantially identical structure to the planar portion 66 and the offset portion 68 of the first header 50 illustrated in FIG. 2, with the only exception being that the offset portion 268 only increases in distance from a plane defined by the planar portion 266 when progressing away therefrom without a symmetrically arranged portion having a decreasing distance from the plane before returning to the plane. The offset portion 268 is accordingly formed at an end of the header 250 with an end of the offset portion 268 merging into the plane of a trough 270 of the header 250.

The header 250 accordingly appreciates the same benefits as the first and second headers 50, 150 while simply moving the improved stress distribution from a centrally located region of the header 50 to an end region of the header 250. As mentioned above, one possible configuration of a heat exchanger causing variable temperature distributions may include a varying distance between an associated fluid port and each of the heat exchanger tubes in fluid communication therewith. The header tank 212 accordingly illustrates one possible configuration wherein the offset portion 268 is selected to be arranged adjacent or in alignment with the corresponding fluid port 244 due to the temperature of the first fluid passing through the header tank 212 potentially being maximized or minimized when entering the fluid port 244 to cause the header 250 to be most susceptible to thermal cycling adjacent the fluid port 244.

The header tank 212 may be used in conjunction with a secondary header tank (not shown) arranged substantially symmetric relative to the header tank 212 in both the vertical and horizontal directions from the perspective of FIG. 7 to form a heat exchanger having a flow configuration wherein the first fluid enters the heat exchanger adjacent a corner of the heat exchanger before exiting the heat exchanger adjacent an opposing corner of the heat exchanger.

Figure 8:
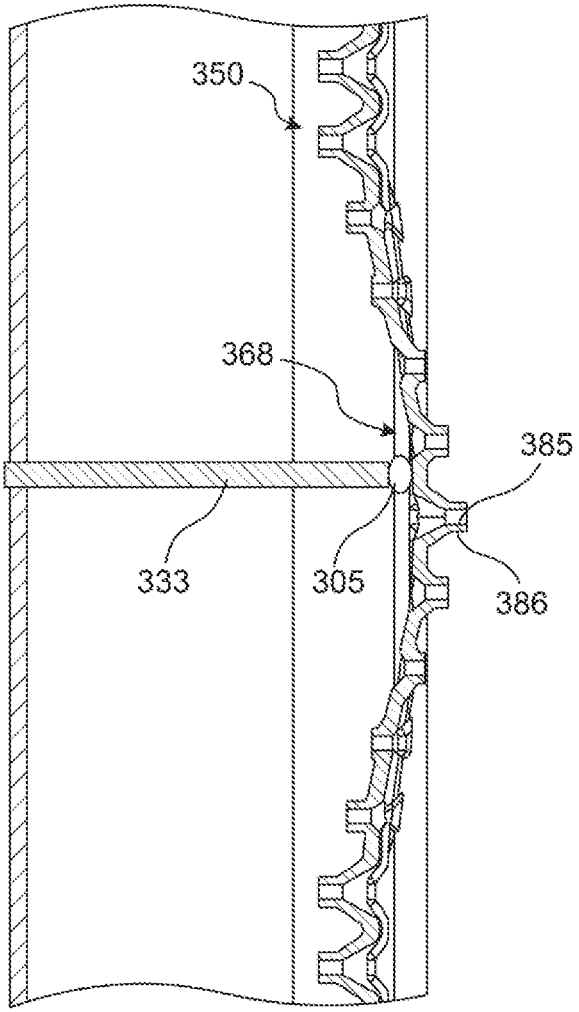
FIG. 8 is a fragmentary cross-sectional view of a header tank having a header according to yet another embodiment of the invention.

FIG. 8 illustrates a header 350 having an offset portion 368 according to another embodiment of the invention. The offset portion 368 of the header 350 is substantially identical to the previously disclosed offset portion 68 of the first header 50 except that the offset portion 368 includes a centrally located tube projection 386 and tube opening 385 as opposed to a pair of tube openings straddling a center of the offset portion 368. An associated partition 333 may accordingly be caused to engage an associated sealing element 305 to either side of the centrally located tube projection 386. The header 350 otherwise includes the same benefits as described herein with reference to the first header 50.

The various different header configurations disclosed herein may be adapted for any type of heat exchanger having any type of flow configuration, as desired. In some embodiments, a single header may include multiple offset portions spaced from each other in the longitudinal direction of the header. For example, an end of the header may include an offset portion similar to that disclosed in FIG. 7 while an internally located offset portion may be similar to that disclosed in FIG. 2. The header may include one of the offset portions corresponding to each feature of the heat exchanger likely to cause variations in thermal expansion thereof, such as each of the fluid ports associated with the header or each of the partitions changing a direction of flow of the first fluid.

The disclosed header configurations may also be used in conjunction with a traditional header configuration including a planar array of tube openings, as desired.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A header for a header tank of a heat exchanger, the header comprising:

a header wall defining a tube receiving portion having a plurality of tube openings formed therethrough configured to receive tubes therein and spaced apart in a longitudinal direction of the header, the tube receiving portion including a planar portion and an offset portion, the planar portion disposed on a first plane and the offset portion having a variable distance from the first plane as the offset portion extends away from the planar portion with respect to the longitudinal direction of the header, wherein the plurality of tube openings includes a plurality of first tube openings and a plurality of second tube openings, wherein each of the plurality of first tube openings is formed through one of a plurality of first tube projections projecting from the planar portion and wherein each of the plurality of second tube openings is formed through one of a plurality of second tube projections projecting from the offset portion, wherein each of the plurality of first tube projections projects in a first direction, at least one of the plurality of second tube projections projects in the first direction, and at least one of the plurality of second tube projections projects in a second direction opposite the first direction, wherein the at least one of the plurality of second tube projections projecting in the second direction results in the tubes received therein having a shorter length than the tubes received in the plurality of first tube projections projecting in the first direction, thereby minimizing a thermal expansion or contraction of the tubes received in the at least one of the plurality of second tube projections projecting in the second direction to minimize a stress between the tubes and the plurality of second tube projections.

2. The header of claim 1, wherein a direction of projection of the plurality of second tube projections is reversed as the offset portion extends away from the planar portion with respect to the longitudinal direction of the header.

3. The header of claim 2, wherein the direction of projection of the plurality of second tube projections is reversed where a surface of the offset portion changes from having a convex shape to having a concave shape as the offset portion extends away from the planar portion with respect to the longitudinal direction of the header.

4. The header of claim 1, wherein a distance of the offset portion from the first plane is increased as the offset portion extends away from the planar portion with respect to the longitudinal direction of the header until the offset portion is arranged on a second plane spaced from and parallel to the first plane.

5. The header of claim 4, wherein the header wall defines a coupling portion circumscribing the tube receiving portion, the coupling portion including a seal engaging surface arranged on the second plane.

6. The header of claim 1, wherein the offset portion is formed at an end of the tube receiving portion.

7. The header of claim 1, wherein the planar portion includes a first planar portion and a second planar portion, wherein the offset portion is disposed between the first planar portion and the second portion.

8. The header of claim 7, wherein the offset portion is symmetric about a plane arranged perpendicular to the longitudinal axis of the header.

9. The header of claim 8, wherein the offset portion includes a convex surface adjacent each of the first planar portion and the second planar portion and a centrally located concave surface.

10. A header tank for a heat exchanger comprising:

a casing having a hollow interior; and a header coupled to the casing, the header comprising a header wall defining a tube receiving portion having a plurality of tube openings formed therethrough and spaced apart in a longitudinal direction of the header, the tube receiving portion including a planar portion and an adjacent offset portion, the planar portion disposed on a first plane and the offset portion having a variable distance from the first plane as the offset portion extends away from the planar portion with respect to the longitudinal direction of the header, wherein the plurality of tube openings includes a plurality of first tube openings and a plurality of second tube openings, wherein each of the plurality of first tube openings is formed through one of a plurality of first tube projections projecting from the planar portion and wherein each of the plurality of second tube openings is formed through one of a plurality of second tube projections projecting from the offset portion, wherein each of the plurality of first tube projections projects in a first direction and at least one of the plurality of second tube projections projects in a second direction opposite the first direction, wherein the at least one of the plurality of second tube projections projecting in the second direction results in the tubes received therein having a shorter length than the tubes received in the plurality of first tube projections projecting in the first direction, thereby minimizing a thermal expansion or contraction of the tubes received in the at least one of the plurality of second tube projections projecting in the second direction to minimize a stress between the tubes and the plurality of second tube projections.

11. The header tank of claim 10, wherein the offset portion of the tube receiving portion is aligned with one of a fluid port of the first casing or a partition dividing the header tank into a first chamber and a second chamber.

12. A heat exchanger comprising:

a first header tank including a hollow first casing and a first header, the first header comprising a header wall defining a tube receiving portion having a plurality of tube openings formed therethrough and spaced in a longitudinal direction of the first header, the tube receiving portion including a planar portion and an adjacent offset portion, the planar portion disposed on a first plane and the offset portion having a variable distance from the first plane as the offset portion extends away from the planar portion with respect to the longitudinal direction of the first header;

a second header tank including a hollow second casing and a second header; and a plurality of heat exchanger tubes extending between the first header tank and the second header tank, wherein the plurality of tube openings includes a plurality of first tube openings and a plurality of second tube openings, wherein each of the plurality of first tube openings is formed through one of a plurality of first tube projections projecting from the planar portion configured to receive a first end of one of the heat exchanger tubes and wherein each of the plurality of second tube openings is formed through one of a plurality of second tube projections projecting from the offset portion configured to receive a second end of one of the heat exchanger tubes, wherein each of the plurality of first tube projections projects in a first direction and at least one of the plurality of second tube projections projects in a second direction opposite the first direction, wherein the at least one of the plurality of second tube projections projecting in the second direction results in the heat exchanger tubes received therein having a shorter length than the heat exchanger tubes received in the plurality of first tube projections projecting in the first direction, thereby minimizing a thermal expansion or contraction of the tubes received in the at least one of the plurality of second tube projections projecting in the second direction to minimize a stress between the tubes and the plurality of second tube projections.

13. The heat exchanger of claim 12, wherein the first header tank includes a partition dividing the first header tank into a first chamber and a second chamber, wherein the partition is aligned with the offset portion of the tube receiving portion with respect to the longitudinal direction of the first header.

14. The heat exchanger of claim 13, wherein a first fluid flows through the heat exchanger by passing through the first chamber, a first set of the plurality of heat exchanger tubes formed to a first side of the partition, the second header tank, a second set of the plurality of heat exchanger tubes formed to a second side of the partition, and the second chamber to form a substantially U-shaped flow configuration.

15. The heat exchanger of claim 12, wherein the first casing includes a fluid port, wherein the fluid port is aligned with the offset portion of the tube receiving portion with respect to the longitudinal direction of the first header.

16. The heat exchanger of claim 15, wherein the fluid port is disposed adjacent an end of the first header.

17. The heat exchanger of claim 15, wherein a first fluid flows through the heat exchanger by passing in order through the fluid port, the first header tank, each of the plurality of heat exchanger tubes, and the second header tank.

* * * * *